US012715037B2

(12) United States Patent
Shin et al.

(10) Patent No.: US 12,715,037 B2
(45) **Date of Patent: *Aug. 25, 2026**

(54) METHOD FOR MANUFACTURING METAL FOAM

(71) Applicant: LG CHEM, LTD., Seoul (KR)

(72) Inventors: Jong Min Shin, Daejeon (KR); Dong Woo Yoo, Daejeon (KR); Jin Kyu Lee, Daejeon (KR)

(73) Assignee: LG CHEM, LTD., Seoul (KR)

( * ) Notice: Subject to any disclaimer, the term of this patent is extended or adjusted under 35 U.S.C. 154(b) by 1287 days.

This patent is subject to a terminal disclaimer.

(21) Appl. No.: 16/329,991

(22) PCT Filed: Oct. 12, 2017

(86) PCT No.: PCT/KR2017/011234
§ 371 (c)(1),
(2) Date: Mar. 1, 2019

(87) PCT Pub. No.: WO2018/070796
PCT Pub. Date: Apr. 19, 2018

(65) Prior Publication Data

US 2022/0281003 A1 Sep. 8, 2022

(30) Foreign Application Priority Data

Oct. 14, 2016 (KR) ..... 10-2016-0133352

(51) Int. Cl.
*B22F 7/00* (2006.01)
*B22F 1/10* (2022.01)
(Continued)

(52) U.S. Cl.
CPC ..... *B22F 7/002* (2013.01); *B22F 1/10* (2022.01); *B22F 3/105* (2013.01); *B22F 3/11* (2013.01);
(Continued)

(58) Field of Classification Search
CPC ..... B22F 7/002–004; B22F 2003/1053
See application file for complete search history.

(56) References Cited

U.S. PATENT DOCUMENTS 2,254,549 A * 9/1941 Small ..... B22F 3/001 106/38.9
3,186,871 A * 6/1965 Donohue ..... H01M 4/80 29/623.5

(Continued)

FOREIGN PATENT DOCUMENTS

CN 105854629 A * 8/2016 ..... B01D 46/543
DE 3015981 A * 11/1981 ..... B22F 3/105

(Continued)

OTHER PUBLICATIONS

Rudnev et al. Inductiom Surface Hardening of Steels. ASM Handbook, vol. 4A, Steel Heat Treating Fundamentals and Processes. J. Dossett and G.E. Totten, eds. 2013 ASM International. 438-461. (Year: 2013).*

(Continued)

*Primary Examiner* — Stephani Hill
(74) *Attorney, Agent, or Firm* — SALIWANCHIK, LLOYD & EISENSCHENK

(57) ABSTRACT

The present application provides a method for manufacturing a metal foam. The present application can provide a method for manufacturing a metal foam, which is capable of forming a metal foam including uniformly formed pores and having excellent mechanical properties as well as the desired porosity, and a metal foam having the above characteristics. In addition, the present application can provide a method capable of forming a metal foam in which the above-mentioned physical properties are ensured, while being in the form of a thin film or sheet, within a fast process time, and such a metal foam.

10 Claims, 1 Drawing Sheet

(51) Int. Cl.
*B22F 3/105* (2006.01)
*B22F 3/11* (2006.01)

(52) U.S. Cl.
CPC ..... *B22F 2202/05* (2013.01); *B22F 2202/06* (2013.01); *B22F 2999/00* (2013.01)

(56) References Cited

U.S. PATENT DOCUMENTS

| | | | | | |
|---|---|---|---|---|---|
| 3,433,632 | A * | 3/1969 | Elbert | B22F 7/002 | 419/36 |
| 4,225,346 | A * | 9/1980 | Helliker | H01M 4/80 | 419/36 |
| 5,149,360 | A * | 9/1992 | Koehler | B01D 39/2034 | 419/36 |
| 5,698,800 | A * | 12/1997 | Hoshino | B22F 1/10 | 419/36 |
| 5,848,351 | A * | 12/1998 | Hoshino | B22F 3/1125 | 428/553 |
| 6,166,360 | A * | 12/2000 | Ruffini, Sr. | C21D 9/0068 | 219/601 |
| 2005/0207928 | A1* | 9/2005 | Shimizu | C04B 35/111 | 419/2 |
| 2008/0199720 | A1* | 8/2008 | Liu | C22C 1/08 | 419/62 |
| 2011/0020662 | A1 | 1/2011 | Okamoto et al. | | |
| 2016/0151864 | A1* | 6/2016 | Rector | H01L 24/83 | 428/615 |
| 2017/0333992 | A1* | 11/2017 | Gao | B22F 3/1017 | |

FOREIGN PATENT DOCUMENTS

| | | | | | |
|---|---|---|---|---|---|
| JP | H02254106 | | 10/1990 | | |
| JP | 05339605 | | 12/1993 | | |
| JP | H06287608 | | 10/1994 | | |
| JP | 09017672 | | 1/1997 | | |
| JP | 2004332069 | | 11/2004 | | |
| JP | 2006077272 | | 3/2006 | | |
| JP | 2009102701 | | 5/2009 | | |
| JP | 2010123297 | A * | 6/2010 | | |
| JP | 2013084551 | A * | 5/2013 | | |
| JP | 5543257 | | 7/2014 | | |
| KR | 1020020090226 | | 11/2002 | | |
| KR | 1020110038378 | | 4/2011 | | |
| KR | 1020110122275 | | 11/2011 | | |
| KR | 1020150055901 | | 5/2015 | | |
| WO | WO-2016066140 | A1 * | 5/2016 | B22F 1/0074 | |

OTHER PUBLICATIONS

DE 3015981 machine translation (Year: 1981).*

Dorozhkin and Kashitsyn. Determination of the temperature-time region of sintering. Poroshkovaya Metallurgiya (Kiev) (1973), (7), 86-91 (Year: 1973).*

Extended European Search Report corresponding to EP17860413.8, dated Sep. 18, 2019 (8 pages).

International Search Report with English Language translation corresponding to International Patent Application No. PCT/KR2017/011234 mailed Jan. 11, 2018. (5 pages).

* cited by examiner

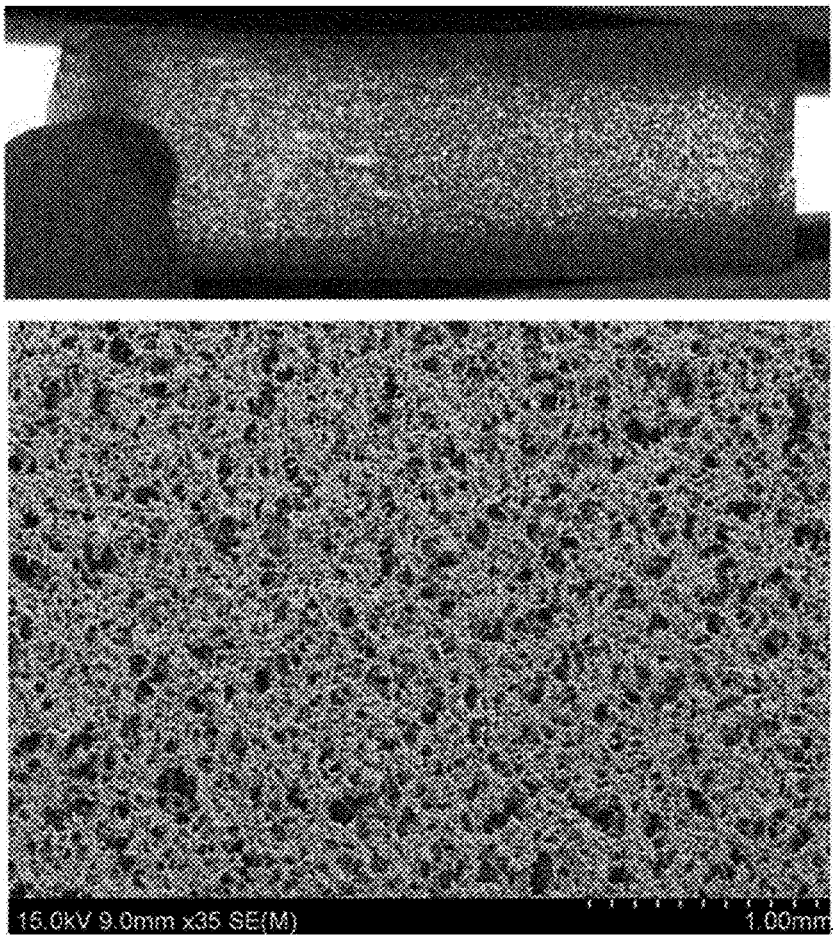
15.0kV 9.0mm x35 SE(M)
1.00mm

METHOD FOR MANUFACTURING METAL FOAM

CROSS REFERENCE TO RELATED APPLICATIONS

This application is a 35 U.S.C. § 371 national stage application of PCT International Application No. PCT/KR2017/11234, filed on Oct. 12, 2017, which claims priority from Korean Patent Application Nos. 10-2016-0133352 filed on Oct. 14, 2016, the contents of which are incorporated herein by reference in their entireties. The above reference PCT International Application was published in the Korean language as International Publication No. WO 2018/070796 A1 on Apr. 19, 2018.

TECHNICAL FIELD

This application relates to a method for manufacturing a metal foam and a metal foam.

BACKGROUND ART

Metal foams can be applied to various fields including lightweight structures, transportation machines, building materials or energy absorbing devices, and the like by having various and useful properties such as lightweight properties, energy absorbing properties, heat insulating properties, refractoriness or environment-friendliness. In addition, metal foams not only have a high specific surface area, but also can further improve the flow of fluids, such as liquids and gases, or electrons, and thus can also be usefully used by being applied in a substrate for a heat exchanger, a catalyst, a sensor, an actuator, a secondary battery, a gas diffusion layer (GDL) or a microfluidic flow controller, and the like.

DISCLOSURE

Technical Problem

It is an object of the present invention to provide a method capable of manufacturing a metal foam in the form of a thin film comprising pores uniformly formed and having excellent mechanical strength as well as a desired level of porosity.

Technical Solution

In the present application, the term metal foam or metal skeleton means a porous structure comprising a metal as a main component. Here, the metal as a main component means that the proportion of the metal is 55 wt % or more, 60 wt % or more, 65 wt % or more, 70 wt % or more, 75 wt % or more, 80 wt % or more, 85 wt % or more, 90 wt % or more, or 95 wt % or more based on the total weight of the metal foam or the metal skeleton. The upper limit of the proportion of the metal contained as the main component is not particularly limited and may be, for example, 100 wt %.

In the present application, the term porous property may mean a case where porosity is 30% or more, 40% or more, 50% or more, 60% or more, 70% or more, 75% or more, or 80% or more. The upper limit of the porosity is not particularly limited, and may be, for example, less than about 100%, about 99% or less, or about 98% or less or so. Here, the porosity can be calculated in a known manner by calculating the density of the metal foam or the like.

In the present application, it is one of main contents that in a process of manufacturing a metal foam, sintering is performed through induction heating of a metal having appropriate conductivity and magnetic permeability. By this method, it is possible to manufacture a metal foam having excellent mechanical properties and porosity controlled to the desired level while containing uniformly formed pores. In the present application, it is possible to form a metal foam having such physical properties even in the form of a thin film or sheet.

Here, the induction heating is a phenomenon in which heat is generated from a specific metal when an electromagnetic field is applied. For example, if an electromagnetic field is applied to a metal having a proper conductivity and magnetic permeability, eddy currents are generated in the metal, and Joule heating occurs due to the resistance of the metal. In the present application, a sintering process through such a phenomenon can be performed. In the present application, the sintering of the metal foam can be performed in a short time by applying such a method, thereby ensuring the processability, and at the same time, the metal foam having excellent mechanical strength as well as being in the form of a thin film having a high porosity can be produced.

Thus, the method for manufacturing a metal foam of the present application may comprise a step of applying an electromagnetic field to a green structure comprising a metal component comprising at least a metal to which the induction heating method is applicable. Heat is generated in the metal by the application of the electromagnetic field to heat the structure, whereby it can be sintered. In the present application, the term green structure means a structure before the process performed to form the metal foam, such as the sintering process, that is, a structure before the metal foam is formed. In addition, even when the green structure is referred to as a porous green structure, the structure is not necessarily porous per se, and may be referred to as a porous green structure for convenience, if it can finally form a metal foam, which is a porous metal structure.

In the present application, the green structure may be formed using a slurry containing a metal component, a solvent and a polymer powder.

The metal component used in the above may comprise at least a metal that is applicable to an induction heating method or an alloy of the metal. For example, the metal component may comprise a metal having a relative magnetic permeability of 90 or more or an alloy of the metal. Here, the relative magnetic permeability ($\mu r$) is a ratio ($\mu/\mu_0$) of the magnetic permeability ($\mu$) of the relevant material to the magnetic permeability ($\mu_0$) in the vacuum. The metal or the alloy of the metal used in the present application may have a relative magnetic permeability of 95 or more, 100 or more, 110 or more, 120 or more, 130 or more, 140 or more, 150 or more, 160 or more, 170 or more, 180 or more, 190 or more, 200 or more, 210 or more, 220 or more, 230 or more, 240 or more, 250 or more, 260 or more, 270 or more, 280 or more, 290 or more, 300 or more, 310 or more, 320 or more, 330 or more, 340 or more, 350 or more, 360 or more, 370 or more, 380 or more, 390 or more, 400 or more, 410 or more, 420 or more, 430 or more, 440 or more, 450 or more, 460 or more, 470 or more, 480 or more, 490 or more, 500 or more, 510 or more, 520 or more, 530 or more, 540 or more, 550 or more, 560 or more, 570 or more, 580 or more, or 590 or more. The upper limit of the relative magnetic permeability is not particularly limited because the higher the value is, the higher the heat is generated when the electromagnetic field is applied. In one example, the upper limit of the relative magnetic permeability may be, for example, about 300,000 or less.

The metal or the alloy of the metal may also be a conductive metal or an alloy thereof. In the present application, the term conductive metal or alloy of the metal may mean a metal having a conductivity at 20° C. of about 8 MS/m or more, 9 MS/m or more, 10 MS/m or more, 11 MS/m or more, 12 MS/m or more, 13 MS/m or more, or 14.5 MS/m, or an alloy thereof. The upper limit of the conductivity is not particularly limited, and for example, may be about 30 MS/m or less, 25 MS/m or less, or 20 MS/m or less.

In the present application, the metal having the relative magnetic permeability and conductivity as above may be simply referred to as a conductive magnetic metal.

By applying the metal or alloy having the relative permeability and conductivity as above, the sintering by induction heating can be more effectively performed. Such a metal can be exemplified by nickel, iron or cobalt, and the like, and the alloy can be exemplified by ferrite or stainless steel, and the like, without being limited thereto.

The metal component may comprise only the metal having the relative magnetic permeability and conductivity as above, or the alloy thereof, or may also further comprise other metal components together with the metal or alloy thereof. When the other metal component is included, the ratio is not particularly limited, and for example, it can be adjusted so that heat by induction heating generated when an electromagnetic field is applied can be a degree sufficient to sinter the porous green structure. For example, the metal component may comprise, on the basis of weight, 50 wt % or more of the metal having the conductivity and magnetic permeability or the alloy thereof. In another example, the ratio of the metal having the conductivity and permeability or the alloy thereof in the metal component may be about 55 wt % or more, 60 wt % or more, 65 wt % or more, 70 wt % or more, 75 wt % or more, 80 wt % or more, 85 wt % or more, or 90 wt % or more. The upper limit of the ratio of the metal or alloy thereof is not particularly limited, and may be, for example, about 100 wt % or less, or 95 wt % or less. However, the above ratios are exemplary ratios. Since the heat generated by induction heating due to application of an electromagnetic field can be adjusted according to the strength of the electromagnetic field applied, the electrical conductivity and resistance of the metal, and the like, the ratio can be changed depending on specific conditions.

The metal component forming the green structure may be in the form of powder. For example, the metal or alloy thereof in the metal component may have an average particle diameter in a range of about 0.1 μm to about 200 μm. In another example, the average particle diameter may be about 0.5 μm or more, about 1 μm or more, about 2 μm or more, about 3 μm or more, about 4 μm or more, about 5 μm or more, about 6 μm or more, about 7 μm or more, or about 8 μm or more. In another example, the average particle diameter may be about 150 μm or less, 100 μm or less, 90 μm or less, 80 μm or less, 70 μm or less, 60 μm or less, 50 μm or less, 40 μm or less, 30 μm or less, or 20 μm or less. As the first and second metals, those having different average particle diameters may also be applied. The average particle diameter can be selected from an appropriate range in consideration of the shape of the desired metal foam, for example, the thickness or porosity of the metal foam, and the like, which is not particularly limited.

The slurry forming the green structure may comprise a solvent together with the metal component. As the solvent, an appropriate solvent may be used in consideration of solubility of the slurry component, for example, the metal component or a polymer powder, and the like. For example, as the solvent, those having a dielectric constant within a range of about 10 to 120 can be used. In another example, the dielectric constant may be about 20 or more, about 30 or more, about 40 or more, about 50 or more, about 60 or more, or about 70 or more, or may be about 110 or less, about 100 or less, or about 90 or less. Such a solvent may be exemplified by water, an alcohol having 1 to 8 carbon atoms such as ethanol, butanol or methanol, DMSO (dimethyl sulfoxide), DMF (dimethyl formamide) or NMP (N-methylpyrrolidinone), and the like, but is not limited thereto.

Such a solvent may be present in the slurry at a ratio of about 50 to 300 parts by weight relative to 100 parts by weight of the metal component, but is not limited thereto. In another example, the ratio may be about 60 parts by weight or more, about 70 parts by weight or more, about 80 parts by weight or more, or about 90 parts by weight or more. In another example, the ratio may be about 290 parts by weight or less, 280 parts by weight or less, 270 parts by weight or less, 260 parts by weight or less, 250 parts by weight or less, 240 parts by weight or less, 230 parts by weight or less, 220 parts by weight or less, 210 parts by weight or less, 200 parts by weight or less, 190 parts by weight or less, 180 parts by weight or less, 170 parts by weight or less, 160 parts by weight or less, 150 parts by weight or less, 140 parts by weight or less, 130 parts by weight or less, 120 parts by weight or less, 110 parts by weight or less, or about 100 parts by weight or less.

The slurry may further comprise a polymer powder. Such a polymer powder may be a spacer holder, i.e., a component for forming pores in the finally formed metal foam. As such a polymer powder, a component having low solubility in the solvent is used. In one example, as the polymer powder, a polymer powder having a solubility in the solvent of 5 mg/mL or less at room temperature may be used. In another example, the solubility may be about 4.5 mg/mL or less, about 4 mg/mL or less, about 3.5 mg/mL or less, about 3 mg/mL or less, about 2.5 mg/mL or less, about 2 mg/mL or less, about 1.5 mg/mL or less, or about 1 mg/mL or less. The lower limit of the solubility may be, for example, 0 mg/mL or about 0.5 mg/mL. The kind of this polymer powder is not particularly limited and may be selected in consideration of the solubility of the relevant powder depending on the kind of the solvent and the like applied upon preparing the slurry. For example, the polymer powder may be exemplified by powders of alkyl celluloses such as methyl cellulose or ethyl cellulose, polyalkylene carbonates such as polypropylene carbonate or polyethylene carbonate, or a polyvinyl alcohol-based polymer such as polyvinyl alcohol or polyvinyl acetate, and the like, but is not limited thereto.

In the present application, the term room temperature is a natural temperature without warming or cooling, and for example, may be a temperature in a range of about 15° C. to 30° C., or about 20° C. or about 25° C. or so.

The polymer powder may be present in the slurry at a ratio of about 10 to 100 parts by weight relative to 100 parts by weight of the metal component, but is not limited thereto. That is, the ratio can be adjusted in consideration of the desired porosity and the like. Also, the average particle diameter of the polymer powder may be controlled in consideration of the size of the desired pores and the like. For example, the ratio may be about 15 parts by weight or more, about 20 parts by weight or more, about 25 parts by weight or more, or about 30 parts by weight or more. Furthermore, in another example, the ratio may be about 90 parts by weight or less, about 80 parts by weight or less, about 70 parts by weight or less, about 60 parts by weight or less, about 50 parts by weight or less, or about 40 parts by weight or less.

The slurry may further comprise a binder if necessary. Unlike the polymer powder as the spacer holder, those well dissolved in the solvent can be applied as the binder. The binder serves to support so as not to disperse metal particles and polymer particles upon coating or forming a film of the polymer slurry. In one example, as the binder, a polymer binder having a solubility in the solvent of 100 mg/mL or more at room temperature may be used. In another example, the solubility may be 110 mg/mL or more, 120 mg/mL or more, 130 mg/mL or more, 140 mg/mL or more, 150 mg/mL or more, 160 mg/mL or more, or 170 mg/mL or more. In another example, the solubility may be about 500 mg/mL or less, about 450 mg/mL or less, about 400 mg/mL or less, about 350 mg/mL or less, about 300 mg/mL or less, about 250 mg/mL or less, or about 200 mg/mL or less. Here, the solubility of the binder can be confirmed in the same manner as in the case of the polymer powder. The kind of this binder is not particularly limited and may be selected in consideration of the solubility of the relevant binder and the like, depending on the type of the solvent or the like used upon producing the slurry. For example, as the binder, a suitable kind may be selected among the already described polymers used as the polymer powder in consideration of the kind selected as the polymer powder and the kind of the applied solvent.

The binder may be present in the slurry at a ratio of about 1 to 15 parts by weight relative to 100 parts by weight of the metal component, but is not limited thereto. That is, the ratio can be controlled in consideration of the desired viscosity of the slurry, maintenance efficiency by the binder, and the like. In another example, the ratio of the binder may be 2 parts by weight or more, 3 parts by weight or more, 4 parts by weight or more, 5 parts by weight or more, 6 parts by weight or more, 7 parts by weight or more, 8 parts by weight or more, or 9 parts by weight or more.

The slurry may also comprise, in addition to the above-mentioned components, known additives which are additionally required.

The method of forming the green structure using the slurry as above is not particularly limited. In the field of manufacturing metal foams, various methods for forming the green structure are known, and in the present application all of these methods can be applied. For example, the green structure may be formed by holding the slurry in an appropriate template, or by coating the slurry in an appropriate manner.

The shape of such a green structure is not particularly limited as it is determined depending on the desired metal foam. In one example, the green structure may be in the form of a film or sheet. For example, when the structure is in the form of a film or sheet, the thickness may be about 5,000 μm or less, 4,000 μm or less, 3,000 μm or less, 2,000 μm or less, 1,500 μm or less, 1,000 μm or less, 900 μm or less, 800 μm or less, 700 μm or less, 600 μm or less, 500 μm or less, 400 μm or less, 300 μm or less, 200 μm or less, or 150 μm or less. Metal foams have generally brittle characteristics due to their porous structural features, so that there are problems that they are difficult to be manufactured in the form of films or sheets, particularly thin films or sheets, and are easily broken even when they are made. However, according to the method of the present application, it is possible to form a metal foam having pores uniformly formed inside and excellent mechanical properties as well as a thin thickness. The lower limit of the structure thickness is not particularly limited. For example, the film or sheet shaped structure may have a thickness of about 50 μm or more, or about 100 μm or more.

When an electromagnetic field is applied to the above structure, Joule heat is generated by the induction heating phenomenon in the conductive magnetic metal, whereby the structure can be sintered. At this time, the conditions for applying the electromagnetic field are not particularly limited as they are determined depending on the kind and ratio of the conductive magnetic metal in the green structure, and the like. For example, the induction heating can be performed using an induction heater formed in the form of a coil or the like. In addition, the induction heating can be performed, for example, by applying a current of 100 A to 1,000 A or so. In another example, the applied current may have a magnitude of 900 A or less, 800 A or less, 700 A or less, 600 A or less, 500 A or less, or 400 A or less. In another example, the current may have a magnitude of about 150 A or more, about 200 A or more, or about 250 A or more.

The induction heating can be performed, for example, at a frequency of about 100 kHz to 1,000 kHz. In another example, the frequency may be 900 kHz or less, 800 kHz or less, 700 kHz or less, 600 kHz or less, 500 kHz or less, or 450 kHz or less. In another example, the frequency may be about 150 kHz or more, about 200 kHz or more, or about 250 kHz or more.

The application of the electromagnetic field for the induction heating can be performed within a range of, for example, about 1 minute to 10 hours. In another example, the application time may be about 9 hours or less, about 8 hours or less, about 7 hours or less, about 6 hours or less, about 5 hours or less, about 4 hours or less, about 3 hours or less, about 2 hours or less, about 1 hour or less, or about 30 minutes or less.

The above-mentioned induction heating conditions, for example, the applied current, the frequency and the application time, and the like may be changed in consideration of the kind and the ratio of the conductive magnetic metal, as described above.

The sintering of the green structure may be carried out only by the above-mentioned induction heating, or may also be carried out by applying an appropriate heat, together with the induction heating, that is, the application of the electromagnetic field, if necessary.

The present application also relates to a metal foam. The metal foam may be one manufactured by the above-described method. Such a metal foam may comprise, for example, at least the above-described conductive magnetic metal. The ratio of the above-described conductive magnetic metal in the metal foam may comprise, on the basis of weight, 30 wt % or more, as described above. In another example, the ratio of the conductive magnetic metal in the metal foam may be about 35 wt % or more, about 40 wt % or more, about 45 wt % or more, about 50 wt % or more, about 55 wt % or more, about 60 wt % or more, 65 wt % or more, 70 wt % or more, 75 wt % or more, 80 wt % or more, 85 wt % or more, or 90 wt % or more. The upper limit of the ratio of the metal is not particularly limited, and may be, for example, about 100 wt % or less, or 95 wt % or less.

The metal foam may have a porosity in a range of about 40% to 99%. As mentioned above, according to the method of the present application, porosity and mechanical strength can be controlled, while comprising uniformly formed pores. Accordingly, the metal foam may also be present in the form of thin films or sheets. In one example, the metal foam may be in the form of a film or sheet. The metal foam of such a film or sheet form may have a thickness of about 5,000 μm or less, 2,000 μm or less, 1,500 μm or less, 1,000 μm or less, 900 μm or less, 800 μm or less, or 700 μm or less. For example, the film or sheet shaped metal foam may have a thickness of about 50 μm or more, about 100 μm or more, about 150 μm or more, about 200 μm or more, about 250 μm or more, about 300 μm or more, about 350 μm or more, about 400 μm or more, about 450 μm or more, or about 500 μm or more.

Such metal foams can be utilized in various applications where a porous metal structure is required. In particular, according to the method of the present application, it is possible to manufacture a thin film or sheet shaped metal foam having excellent mechanical strength as well as the desired level of porosity, as described above, thus expanding applications of the metal foam as compared to the conventional metal foam.

Advantageous Effects

The present application can provide a method for manufacturing a metal foam, which is capable of forming a metal foam comprising uniformly formed pores and having excellent mechanical properties as well as the desired porosity, and a metal foam having the above characteristics. Also, the present application can provide a method capable of forming a metal foam in which the above-mentioned physical properties are ensured, while being in the form of a thin film or sheet, and such a metal foam. In addition, a fast process time can be ensured through calcining by electromagnetic field induction heating.

BRIEF DESCRIPTION OF DRAWINGS

FIG. 1 is a photograph of the sheet produced in Example.

MODE FOR INVENTION

Hereinafter, the present application will be described in detail by way of examples and comparative examples, but the scope of the present application is not limited to the following examples.

Example 1

Nickel having a conductivity of about 14.5 MS/m at 20° C. and a relative magnetic permeability of about 600 was used as a metal component. The nickel powder having an average particle diameter in a range of about 5 to 10 μm was blended with water as a solvent, and methyl cellulose and ethyl cellulose to prepare a slurry. Here, the solubility of methyl cellulose in the water is about 180 mg/mL at room temperature, and the solubility of ethyl cellulose in the water is about 1 mg/mL at room temperature. Upon preparing the slurry, the weight ratio of nickel powder, water, methyl cellulose and ethyl cellulose (nickel powder:water:methyl cellulose:ethyl cellulose) was set as about 2.8:2.7:0.3:1. The slurry was coated on a quartz plate in the form of a film to form a green structure. Subsequently, the green structure was dried at a temperature of about 110° C. for about 30 minutes and then an electromagnetic field was applied to the green structure with a coil-type induction heater. The electromagnetic field was formed by applying a current of about 350 A at a frequency of about 380 kHz, and the electromagnetic field was applied for about 5 minutes. After the application of the electromagnetic field, the sintered green structure was put into water and subjected to sonication cleaning to produce a nickel sheet having a thickness of about 130 μm in the form of a film. A photograph of the produced sheet was shown in FIG. 1. The produced nickel sheet had a porosity of about 82% and a tensile strength of about 3.4 MPa.

Example 2

A nickel sheet having a thickness of about 120 μm in the form of a film was produced in the same manner as in Example 1, except that a nickel powder having an average particle diameter in a range of about 30 to 40 μm was used as the metal component and upon preparing the slurry, a weight ratio of nickel powder, water, methyl cellulose and ethyl cellulose (nickel powder:water:methyl cellulose:ethyl cellulose) was set as 2.8:2.7:0.3:1. The produced nickel sheet had a porosity of about 81% and a tensile strength of about 4.1 MPa.

What is claimed is:

1. A method for manufacturing a metal foam comprising applying an electromagnetic field to a green structure formed by using a slurry, wherein the applying of the electromagnetic field to the green structure sinters the green structure to form the metal foam, wherein the green structure, formed by coating the slurry on a plate, is a film having a thickness of 200 μm or less, wherein the slurry consists of a metal component, water, ethyl cellulose, and a binder, wherein the metal component comprises a conductive metal having a relative magnetic permeability of 90 or more or an alloy comprising the conductive metal, wherein the water is contained in the slurry at a ratio of 80 to 300 parts by weight relative to 100 parts by weight of the metal component, wherein the ethyl cellulose is contained in the slurry at a ratio of 10 to 100 parts by weight relative to 100 parts by weight of the metal component, wherein the binder has a solubility in the water of 100 mg/mL or more at room temperature, wherein the metal foam has a porosity of 80% or more, and wherein the electromagnetic field is formed by applying a current in a range of 250 A to 400 A at a frequency in a range of 250 kHz to 400 kHz for a time of 1 minute to 30 minutes.

2. The method for manufacturing a metal foam according to claim 1, wherein the conductive metal is any one selected from the group consisting of iron, nickel, and cobalt.

3. The method for manufacturing a metal foam according to claim 1, wherein the metal component comprises, on the basis of weight, 50 wt % or more of the conductive metal or the alloy containing the conductive metal.

4. The method for manufacturing a metal foam according to claim 1, wherein the metal component has an average particle diameter in a range of 5 to 100 μm.

5. The method for manufacturing a metal foam according to claim 1, wherein the water is contained in the slurry at a ratio of 90 to 300 parts by weight relative to 100 parts by weight of the metal component.

6. The method for manufacturing a metal foam according to claim 1, wherein the ethyl cellulose is contained in the slurry at a ratio of 15 to 100 parts by weight relative to 100 parts by weight of the metal component.

7. The method for manufacturing a metal foam according to claim 1, wherein the binder has the solubility in the water of 110 mg/mL or more at room temperature.

8. The method for manufacturing a metal foam according to claim 7, wherein the binder is an alkyl cellulose, polyalkylene carbonate, or polyvinyl alcohol.

9. The method for manufacturing a metal foam according to claim 7, wherein the binder is contained in the slurry at a ratio of 1 to 15 parts by weight relative to 100 parts by weight of the metal component.

10. The method for manufacturing a metal foam according to claim 1, further comprising applying heat to the green structure while applying the electromagnetic field to the green structure.

* * * * *